US008147098B2

(12) United States Patent
Hendriks

(10) Patent No.: US 8,147,098 B2
(45) Date of Patent: Apr. 3, 2012

(54) ELECTRIC REFLECTOR LAMP

(75) Inventor: Bart Hendriks, Turnhout (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 349 days.

(21) Appl. No.: 12/517,569

(22) PCT Filed: Dec. 4, 2007

(86) PCT No.: PCT/IB2007/054917

§ 371 (c)(1), (2), (4) Date: Jun. 4, 2009

(87) PCT Pub. No.: WO2008/072131

PCT Pub. Date: Jun. 19, 2008

(65) Prior Publication Data

US 2010/0020544 A1 Jan. 28, 2010

(30) Foreign Application Priority Data

Dec. 11, 2006 (EP) ..... 06125843
Mar. 9, 2007 (EP) ..... 07103858

(51) Int. Cl.
*F21V 7/00* (2006.01)
*F21V 17/06* (2006.01)
*F21S 8/00* (2006.01)

(52) U.S. Cl. ..... 362/296.01; 362/341; 362/433; 362/263; 313/113

(58) Field of Classification Search ..... 362/516, 362/519, 546, 548, 549, 261, 433, 434, 263, 362/296.01, 306, 310, 341; 313/110, 113, 313/114, 115, 318.01
See application file for complete search history.

(56) References Cited

U.S. PATENT DOCUMENTS

| | | | | |
|---|---|---|---|---|
| 5,235,498 | A * | 8/1993 | Van Dulmen et al. | 362/549 |
| 6,402,348 | B1 * | 6/2002 | Ouellette et al. | 362/296.01 |
| 6,710,522 | B2 * | 3/2004 | Fransen | 313/113 |
| 7,244,047 | B2 * | 7/2007 | Powell | 362/263 |
| 7,252,421 | B2 * | 8/2007 | Dawson et al. | 362/519 |
| 2005/0094406 | A1 | 5/2005 | Okazaki | |
| 2006/0044810 | A1 | 3/2006 | Hirano et al. | |

FOREIGN PATENT DOCUMENTS

| | | | |
|---|---|---|---|
| CH | 571684 | | 1/1976 |
| DE | 9004680 | U1 | 6/1990 |
| EP | 0985875 | A2 | 3/2000 |
| GB | 2203527 | A | 10/1988 |
| WO | 0248609 | A1 | 6/2002 |

* cited by examiner

*Primary Examiner* — David Crowe

(57) ABSTRACT

A reflector lamp (1) comprising a reflector (2) having an opening (6) opposite to a light emission window (7), an electric lamp (10) comprising a closed lamp vessel (11) positioned with an end portion (16) in the lamp opening of the reflector, an electric element (13) arranged on the optical axis (4) in the lamp vessel, and a support body (20). The support body comprises reflector fastening means (22) for fastening the support body to the reflector, and lamp fastening means (21) for fastening the support body to the end portion of the lamp vessel. Viewed in a direction from the lamp opening along the optical axis towards the light emission window, the support body is fastened to the reflector solely at a location beyond the lamp opening of the reflector.

14 Claims, 3 Drawing Sheets

ELECTRIC REFLECTOR LAMP

FIELD OF THE INVENTION

The invention relates to an electric reflector lamp according to the preamble of claim 1. The invention further relates to a reflector for use in the reflector lamp.

BACKGROUND OF THE INVENTION

Such a reflector lamp is known from WO-02/48609, in which the support body provides an accurate positioning of the lamp vessel in the reflector. It is a disadvantage of the known reflector lamp that the support body is of a relatively complex construction and that assembly of the lamp is relatively cumbersome. Relatively high stresses are imposed on the (glass) reflector body during said assembly and in an assembled configuration. It is in particular known that high stresses are imposed on the reflector adjacent the opening/neck of the reflector. These stresses are caused by both the mechanical construction and the thermal load on the reflector lamp during operation.

SUMMARY OF THE INVENTION

It is an object of the invention to provide a reflector lamp of the type described in the opening paragraph in which at least one of the above-mentioned disadvantages is counteracted. To achieve this, the lamp as described in the opening paragraph is characterized by the characterizing part of claim 1. In the reflector lamp of the invention there is no (mechanical) connection between the lamp vessel and the reflector in the critical area at or adjacent the lamp opening of the reflector, thus causing the reflector lamp to be subjected to lower (thermal) stresses. As the area at and/or adjacent the lamp opening is covered by the support body to only a relatively small extent, as compared with the conventional known lamps, a free or forced convection, for example an air flow, is made possible. Thus the use of high-power lamps, i.e. of higher power than in conventional constructions, is allowed while approximately the same lifetime of the lamp is maintained as in conventional lamps. Lamps of higher power are, for example, short-arc high-pressure discharge lamps having a nominal power of, for example, 250 to 500 W during stable operation, as well as, for example, a UHP lamp designed for a power of 450 W during continuous steady-state operation.

The first annular wall and the lamp opening are preferably spaced apart by a spacing S in the range of 2 mm to 30 mm in axial direction in the present reflector lamp. The area at and/or adjacent the lamp opening is thus covered to even a lesser extent by the support body compared with the conventional known lamps, and a free or forced convection, for example an air flow, is even better facilitated.

It is advantageous if the reflector fastening means of the support body comprises a second annular wall. Said second annular wall gives the support body an enhanced rigidity and provides a larger contact area between the reflector and the reflector fastening means. Said enhanced rigidity leads to a better controlled positioning of the lamp vessel in the reflector, and said larger contact area provides a better fastening of the support body to the reflector.

An embodiment of the reflector lamp is characterized in that the reflector is without a neck portion. This offers the advantage that there is no knee between the cylindrical part of the reflector at the opening and the reflector shell, resulting in a reduction of reflector shape related stress. Furthermore, the distance between the light- and heat-generating light source and the outside of the reflector is reduced, which leads to a better cooling of the lamp vessel. Though the application of the support body in reflector lamps with the reflector having a neck at the opening will have a beneficial effect with respect to thermal stress and mechanical stress compared with the conventional known reflectors, a reflector without a neck is preferred for the reason mentioned above. If the reflector has a wall thickness adjacent the opening of less than 1.5 times the wall thickness of the reflector at the light emission window, preferably less than 1.25 times, said distance is even more reduced, providing an even better cooling of the lamp vessel.

Another embodiment of the reflector lamp of the invention is characterized in that the support body comprises 2, 3, 4, 5 or 6 legs via which it is fastened to the reflector. A strong fixation and correct positioning of the lamp vessel onto and in the reflector are obtained thereby. The support body is, for example, made of metal, ceramic, high temperature resistant synthetic resin, or glass. These materials are easily connected to the reflector and lamp vessel, for example by cementing, gluing, or by clamping in radial direction. Cementing is a relatively easy method of fastening the support body to the lamp vessel and/or the reflector. Preferably, the coefficient of thermal expansion of the materials of the support body, the lamp vessel, and the reflector match, thus counteracting the occurrence of high mechanical and thermal stresses at the interface Particularly suitable is a support body made from metal sheeting, said material being easily pliable and very suitable for fastening both reflector and lamp vessel through clamping because of its resilience. The support body may be provided with resilient tongues for this purpose.

Yet another embodiment of the reflector lamp is characterized in that the lamp vessel has two mutually opposed end portions each comprising a respective seal. This renders it possible to position the electric element, for example a discharge arc or a filament, in the focal point and on/along the optical axis in a relatively easy manner.

The invention further relates to a reflector for use in a reflector lamp of the invention. The invention makes new designs for the reflector possible, for example in that the neck of the reflector, conventionally used for fastening the lamp vessel and the reflector to one another, can now be omitted. Furthermore, the wall of the reflector may have a substantially constant thickness and be relatively thin compared with the conventional known reflectors because of the absence of the neck. The spider-shaped support body, having 2 to 6 legs, has the advantage that it does not or substantially not increase the built-in dimensions of the reflector lamp in a housing or in an electrical apparatus.

Further advantages, characteristics, and details of the invention will be explained in more detail in the ensuing description of some embodiments. The description is given with reference to the Figures, in which:

DETAILED DESCRIPTION OF THE EMBODIMENTS

Figure 1:
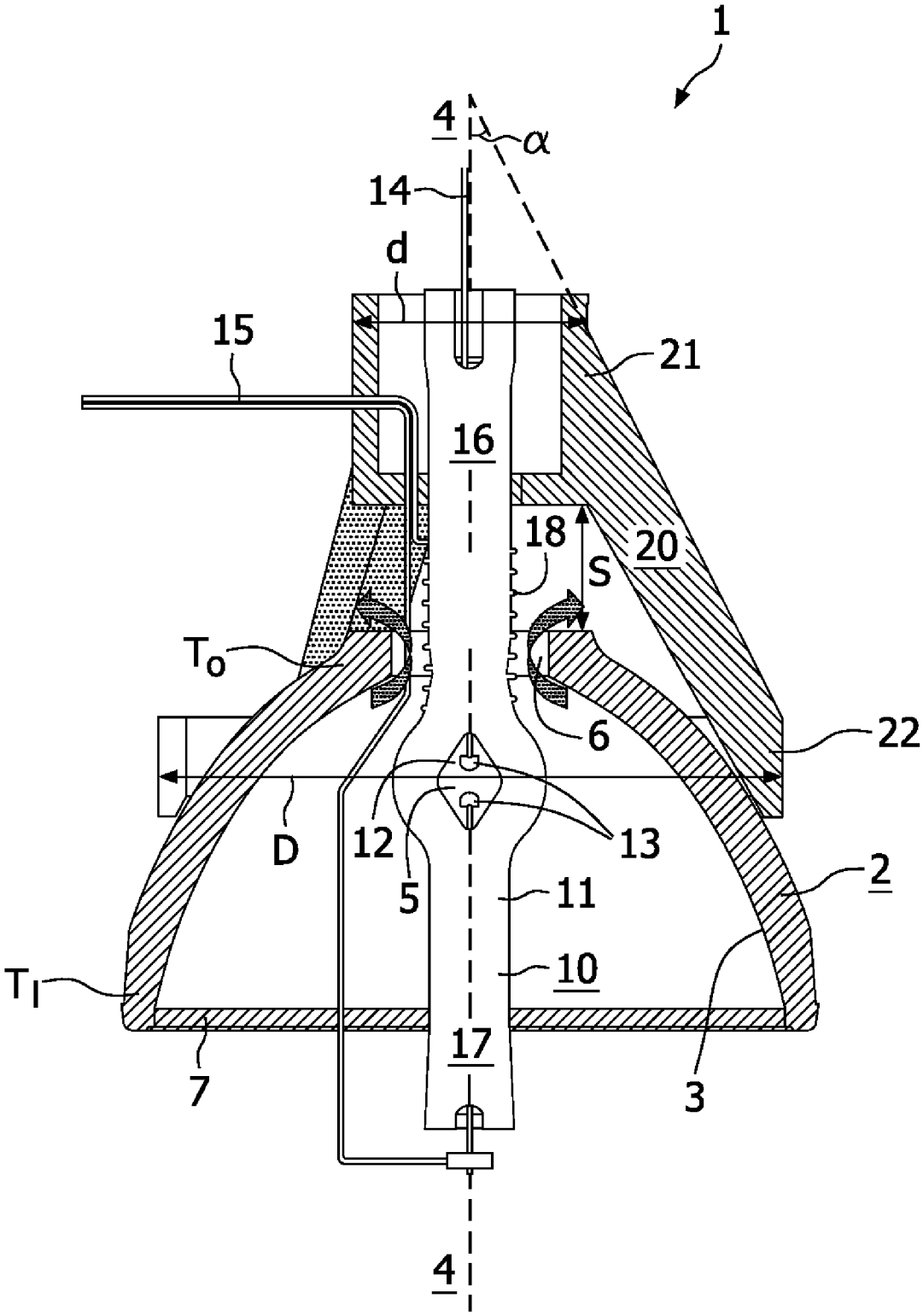
FIG. 1 is a cross-sectional view of a first embodiment of the reflector lamp of the invention.

FIG. 1 shows a reflector lamp 1 comprising a reflector 2 with a concave reflecting portion 3 defining an optical axis 4 and having a focal point 5 on the optical axis, the reflecting surface extending between a lamp opening 6 and a light emission window 7 opposite to the lamp opening of the reflector. The reflector lamp further comprises an electric high-pressure gas discharge lamp 10 comprising a closed lamp vessel 11 positioned with a first end portion 16 in the lamp opening of the reflector, an electric element 13, a pair of mutually opposed electrodes in the Figure, arranged on the optical axis in a space 12 enclosed by the lamp vessel, and current conductors 14, 15 extending from the electric element through respective end portions 16, 17 to the exterior. The electric lamp has an antenna 18 serving as an ignition aid. A support body 20 is provided, said support body comprising reflector fastening means 22 for fastening the support body to the reflector, and lamp fastening 21 means for fastening the support body to the end portion of the lamp vessel only partly covering the opening. In a direction away from the lamp opening along the optical axis towards the light emission window, the support body is fastened to the reflector solely at a location beyond the lamp opening of the reflector, approximately at the focal point of the reflector. As shown in FIG. 1, the reflector is without a neck portion. The reflector is made of hard glass, of borosilicate glass in the lamp shown in FIG. 1, but it may alternatively be made of aluminosilicate glass or glass ceramic. The wall thickness $T_o$ adjacent the opening is less than 1.25 times the wall thickness $T_1$ of the reflector at the light emission window.

Figure 2:
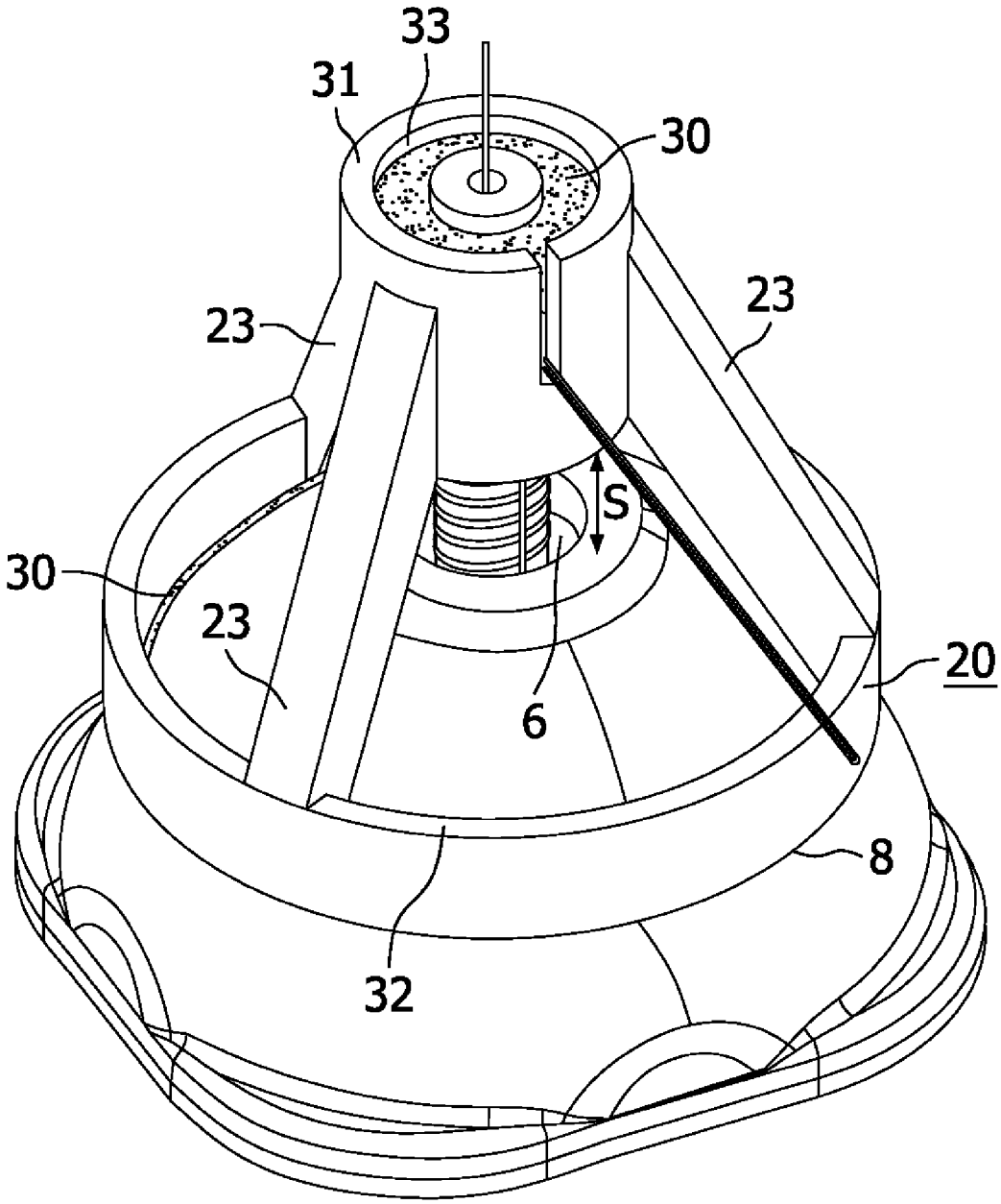
FIG. 2 is a perspective view of the reflector lamp of FIG. 1.

FIG. 2 shows the spider-like construction of the support body of the lamp of FIG. 1 in perspective view. The support body is made of ceramic material, of sintered aluminum oxide in FIG. 2, and comprises as the lamp fastening means a first annular wall 31 around an opening 33. The first annular wall is connected to reflector fastening means comprising three legs 23 and a second annular wall 32. Said legs 23 connect the first annular wall 31 with the second annular wall 32. The second annular wall being concentric with the first annular wall, said first and second annular walls have respective outer diameters d and D, the diameter d of the first annual wall being smaller than the diameter D of the second annular wall (see FIG. 1). The legs extend along the optical axis at acute angles $\alpha$ of about 36° to the optical axis 4 (see FIG. 1) and interconnect the first and second annular walls. The legs are evenly distributed over the circumference 8 of the reflector, i.e. at mutual angles of 120° in a plane projection along the optical axis. Both the lamp vessel and the reflector are fastened to the support body by cement 30. The first annular wall and the lamp opening 6 are spaced apart in axial direction by a spacing S of 8 mm.

Figure 3:
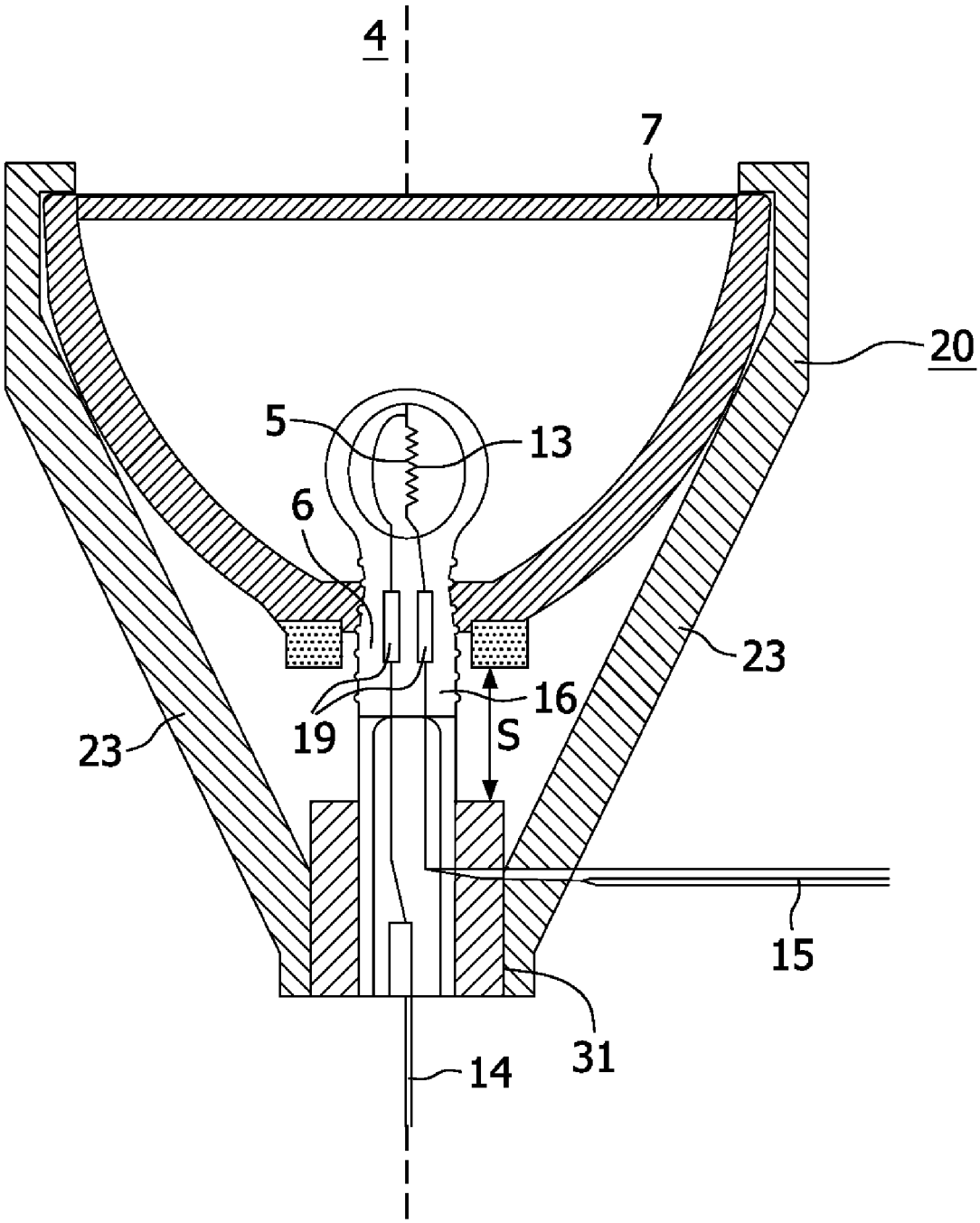
FIG. 3 is a cross-sectional view of another embodiment of the reflector lamp of the invention.

FIG. 3 shows a cross-section of a reflector lamp having a single-ended halogen lamp with a filament 13 as the electric element in the focal point 5 and on the optical axis 4. The support body 20 has no second annular wall and is fastened with its first annular wall 31 to the lamp vessel and is fastened to the reflector at the light emission window 7 by four legs 23 (of which only two are shown). Said four legs are evenly distributed over the circumference of the reflector at mutual angles of 90° in a plane projection along the optical axis 4. The support body is made of metal sheeting, for example corrosion-resistant spring steel. Both the lamp vessel and the reflector are fastened via a respective clamping grip to the support body. The lamp vessel is clamped by its end portion/seal, the reflector is clamped by its wall at the emission window. The first annular wall and the lamp opening 6 are spaced apart in axial direction by a spacing S of 14 mm. The current conductors 14, 15 that extend through the end portion 16 to the exterior each comprise a respective molybdenum foil 19. The lamp vessel is made from quartz glass, i.e. glass having a $SiO_2$ content of at least 95% by weight.

Although only some exemplary embodiments of this invention have been described in detail, those skilled in the art will readily appreciate that many modifications are possible without materially departing from the novel teachings and advantages of the invention. Accordingly, all such modifications, for example in that the reflector has a transparent plate (optionally coated with an anti-reflection layer) positioned in the light emission window, or in that the first end portion of the lamp vessel is provided with an ignition antenna, are intended to fall within the scope of this invention.

The invention claimed is:

1. A reflector lamp comprising:

a reflector with a reflecting surface defining an optical axis and having a focal point on the optical axis, the reflecting surface extending between a lamp opening in the reflector and a light emission window opposite to the lamp opening, an electric lamp comprising a closed lamp vessel positioned with an end portion in the lamp opening, an electric element arranged on the optical axis in the lamp vessel, and a current conductor extending through the end portion from the electric element to the exterior, a support body comprising lamp fastening means for fastening the support body to the end portion of the lamp vessel and reflector fastening means for fastening the support body to the reflector, the lamp fastening means comprising a first annular wall around the end portion of the lamp vessel, the reflector fastening means comprising a plurality of legs that are attached to the first annular wall of the lamp fastening means, each leg extending in a direction from the lamp opening in the reflector along the optical axis towards the light emission window at an acute angle $\alpha$ to the optical axis, characterized in that, viewed in a direction from the lamp opening along the optical axis towards the light emission window, the support body is fastened to the reflector at a location beyond focal point of the reflector, and characterized in that built-in dimensions of the reflector lamp viewed in a projection along the optical axis, are not increased by the support body.

2. A reflector lamp as claimed in claim 1, wherein the plurality of legs is in the range of 2 to 6 legs.

3. A reflector lamp as claimed in claim 1 wherein the reflector fastening means of the support body further comprises a second annular wall, said second annular wall being concentric with the first annular wall and being connected thereto via the legs, and said first and second annular wall have respective outer diameters d and D, the diameter d of the first annual wall being smaller than the diameter D of the second annular wall.

4. A reflector lamp as claimed in claim 1, wherein the first annular wall and the lamp opening are spaced apart in axial direction by a spacing S lying in a range of 2 mm to 30 mm.

5. A reflector lamp as claimed in claim 1, wherein the reflector is without a neck portion.

6. A reflector lamp as claimed in claim 1 wherein the reflector has a wall thickness $T_o$ adjacent the opening that is less than 1.5 times, the wall thickness $T_l$ of the reflector at the light emission window.

7. A reflector lamp as claimed in claim 1 wherein the support body comprises metal, ceramic material, or glass.

8. A reflector lamp as claimed in claim 6, wherein the support body comprises one or more sheets of metal.

9. A reflector lamp as claimed in claim 1, wherein the support body is cemented to the reflector.

10. A reflector lamp as claimed in claim 7, wherein the lamp vessel is held with clamping force by the metal support body.

11. A reflector lamp as claimed in claim 1, characterized in that the lamp vessel has two mutually opposed end portions each comprising a respective seal.

12. Reflector for use in a reflector lamp as claimed in claim 1 characterized in that the reflector has a wall thickness $T_o$ adjacent the opening that is less than 1.5 times the wall thickness $T_l$ of the reflector at the light emission window.

13. A reflector lamp as claimed in claim 1 wherein the reflector has a wall thickness $T_o$ adjacent the opening that is less than 1.25 times the wall thickness $T_l$ of the reflector at the light emission window.

14. Reflector for use in a reflector lamp as claimed in claim 1 characterized in that the reflector has a wall thickness $T_o$ adjacent the opening that is less than 1.25 times the wall thickness $T_l$ of the reflector at the light emission window.

* * * * *